United States Patent [19]

Rudy, Jr. et al.

[11] 4,413,872

[45] Nov. 8, 1983

[54] PRELOADED ELECTRICAL CONNECTOR

[75] Inventors: William J. Rudy, Jr., Annville, Pa.; John A. Zimmerman, Jr., Cape Coral, Fla.

[73] Assignee: AMP Incorporated, Harrisburg, Pa.

[21] Appl. No.: 262,011

[22] Filed: May 11, 1981

[51] Int. Cl.[3] ..... H01R 13/422

[52] U.S. Cl. ..... 339/59 M; 339/95 R; 339/107

[58] Field of Search ..... 339/95 R, 95 D, 97 R, 339/97 P, 99 R, 107, 206 R, 206 P, 207 R, 207 S, 208, 274, 266, 59 R, 59 M

[56] References Cited

U.S. PATENT DOCUMENTS

| | | | |
|---|---|---|---|
| 1,666,991 | 4/1928 | Cohen | 339/274 X |
| 1,917,683 | 7/1933 | Anderson | 339/274 UX |
| 3,500,292 | 3/1970 | Enright et al. | 339/97 R |
| 3,668,615 | 6/1972 | Bury | 339/206 R |
| 3,851,945 | 12/1974 | Collier | 339/97 C |
| 3,858,157 | 12/1974 | Bazille, Jr. | 339/99 R |
| 3,880,488 | 4/1975 | Collier | 339/97 C |
| 3,934,075 | 1/1976 | Dilliplane | 174/75 R |
| 4,062,616 | 12/1977 | Shaffer et al. | 339/99 R |
| 4,129,350 | 12/1978 | Winn | 339/99 R |

FOREIGN PATENT DOCUMENTS

| | | | |
|---|---|---|---|
| 432272 | 8/1926 | Fed. Rep. of Germany | 339/274 |
| 176812 | 10/1961 | Switzerland | 339/274 |

*Primary Examiner*—Howard N. Goldberg

*Attorney, Agent, or Firm*—Frederick W. Raring; Adrian J. LaRue

[57] ABSTRACT

A preloaded electrical connector is described which comprises a housing having a mating face, a wire entry face, and cavities extending through the housing and between the faces. A contact terminal is contained in each of the cavities and each terminal has a wire connecting portion adjacent to the wire entry face. One of the housing sidewalls has an integral housing flap which is hinged to the housing between the faces. The housing flap is in an open condition so that rearward portions of the cavities are open. Each terminal has a channel-shaped wire connecting portion and has a clamping flap integral therewith which is also in an open condition. The clamping flap extends beside the housing flap and when the housing flap is moved to its closed position, it moves the clamping flap to its closed position. In use, wires are positioned in alignment with the channel-shaped connecting portions of the terminals and the housing flap is moved from its open position to its closed position. The clamping flap is also moved to its closed position thereby clamping the wires in the wire connecting portions of the terminals.

15 Claims, 8 Drawing Figures

PRELOADED ELECTRICAL CONNECTOR

FIELD OF THE INVENTION

This invention relates to electrical connectors which are preloaded with electrical terminals. The terminals have wire receiving portions which are adjacent to the wire entry face of the connector housing.

BACKGROUND OF THE INVENTION

U.S. Pat. No. 3,760,335 describes a multi-contact electrical connector having an insulating housing, cavities extending through the housing from the wire entry face to the mating face, and terminals positioned in the cavities. Each terminal has a wire receiving and connecting portion which is adjacent to the wire entry face of the housing. The wire receiving portions are in the form of platelike members having wire receiving slots. The slots have a width such that when a wire is moved laterally of its axis and into a slot, the edges of the slot establish electrical contact with the wire.

Electrical connectors of the general type described in U.S. Pat. No. 3,760,335 have been accepted with enthusiasm in many segments of the electrical industry and are now in widespread use. A distinct advantage of such connectors is that the terminals are preloaded into the connector housing and the connector can then be installed on the ends of wires by a simple hand tool or by the use of a harness making machine of the type shown, for example, in U.S. Pat. No. 4,043,017.

Connectors having wire receiving and connecting portions in the form of wire receiving slots are usually used only with solid wires and in only a few instances have such connectors been used with stranded wires. It is difficult to design a wire receiving slot which is suitable for stranded wires, for several reasons. For example, stranded wires of the same gage may contain different numbers of strands and a slot which is suitable for a wire containing say seven strands, may be unsuitable for a wire containing a larger number of strands. Furthermore, the strands tend to spread apart when they are inserted in the wire receiving slot and the resulting electrical contact between the wire and the terminal may deteriorate.

It would be desirable to provide a connector having the advantages of the known types of preloaded electrical connectors which can be used with stranded wires and which would be usable with different wire sizes and with wires having varying numbers of strands. The present invention is directed to the achievement of a connector of this type.

One embodiment of the connector in accordance with the invention comprises an insulating housing having a mating face, a wire entry face, and sidewalls and endwalls extending between the faces. Cavities extend through the housing and an electrical terminal is preloaded in each cavity. One of the sidewalls of the housing has an integral housing flap which is hinged to the housing at a location between the housing faces. The flap is open prior to installation of the connector on the ends of the wires and the flap is movable to a closed position. When the flap is open, portions of the cavities which extend from the hinge to the wire entry face of the housing are exposed or open on one side to permit the placement of the ends of wires in alignment with the wire connecting portions of the terminals in the housing. Each of the terminals has a wire clamping flap hinged to the terminal adjacent to the housing flap hinge and the clamping flap extends beside the housing flap when the two flaps are in their open position. When the housing flap is moved from its open position to its closed position, it pushes the clamping flap to its closed position. Wires can therefore be connected to the terminals by simply locating the ends of the wires in alignment with the terminals and moving the housing flap to its closed position. The clamping flap will clamp the ends of the wires to the terminals and a stable, low resistance electrical connection will be achieved.

PREFERRED EMBODIMENT OF THE INVENTION

Figure 1:
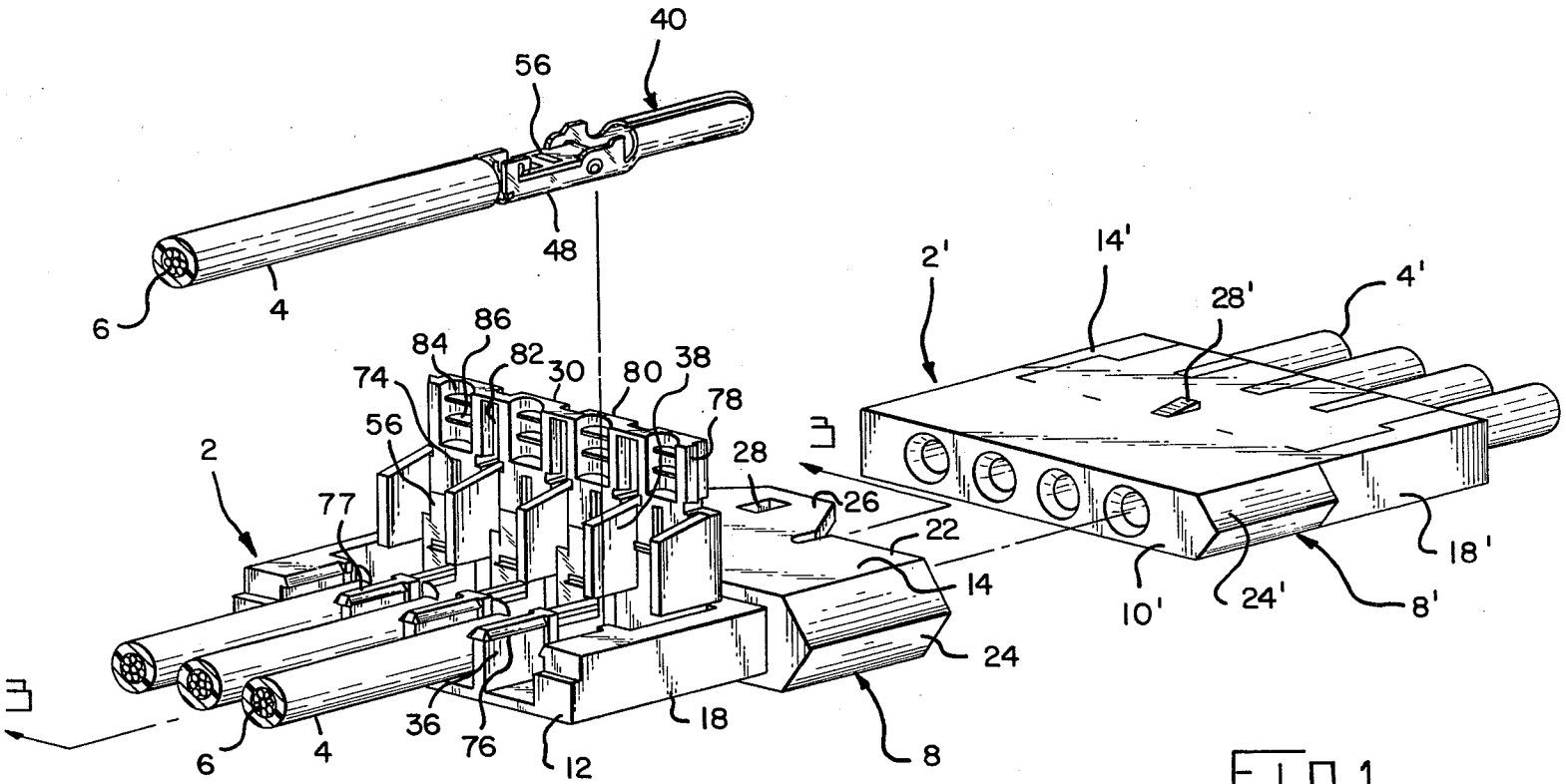
FIG. 1 is a perspective view of of a receptacle connector and a plug connector in accordance with the invention, the housing flap of the receptacle connector being in its open position with one terminal exploded from its cavity.
Figure 2:
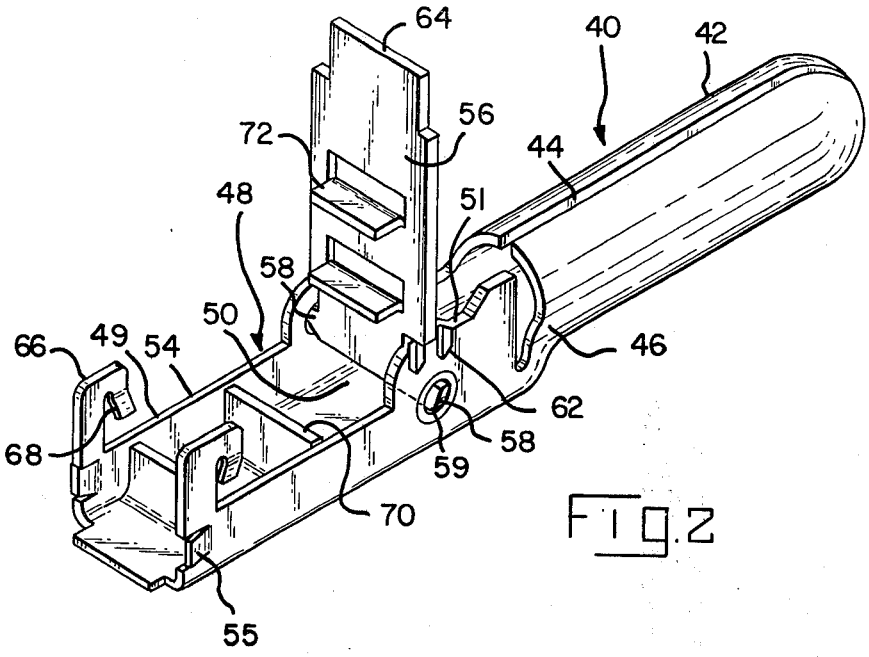
FIG. 2 is a perspective view of a terminal with the clamping flap of the terminal in its open condition.

FIG. 1 shows a connector receptacle 2 and a connector plug 2' in accordance with the invention. The receptacle and the plug can be coupled to each other to connect the conducting cores 6 of wires 4 to the conducting cores of wires 4' which extend to terminals contained in the plug 2'. In the description which follows, only the receptacle 2 is described in detail and the same reference numerals, differentiated by prime marks, will be used for corresponding structural elements in the plug and the receptacle.

The connector plug 2 comprises a housing 8 which is molded of a suitable insulating material, such as a polycarbonate or a filled nylon. The housing has a mating face 10, a wire entry face 12, upper and lower sidewalls 14, 16, and laterally facing endwalls 18, 20. A hood 22 surrounds, and extends beyond, the mating face 10 of the receptacle to provide protection for the contact portions 42 of the terminals 40 in the housing. This hood is non-symmetrical at one side as shown at 24, and the plug housing is similarly non-symmetrical, as shown at 24', so that the plug and receptacle can be mated only when they are properly oriented. An integral tongue 26 extends from the hood and has a central opening 28 therein which receives an ear 28' on the sidewall 14' of the plug in order to latch the plug to the receptacle when the parts are coupled.

Figure 3:
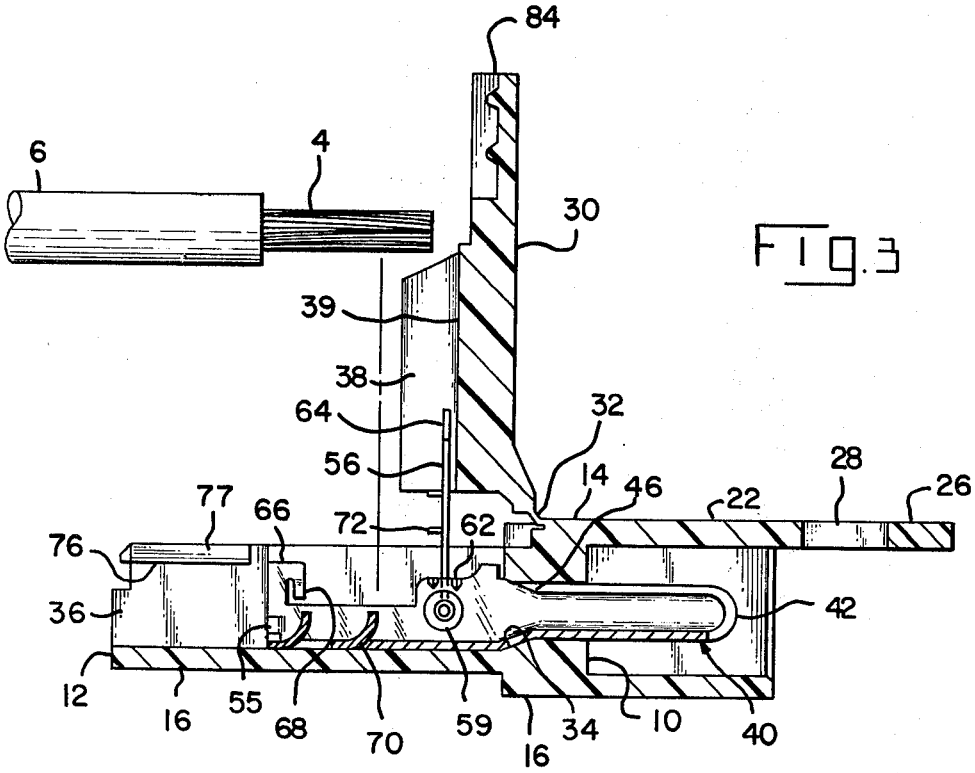
FIG. 3 is a cross-sectional view taken along the lines 3—3 of FIG. 1.
Figure 4:
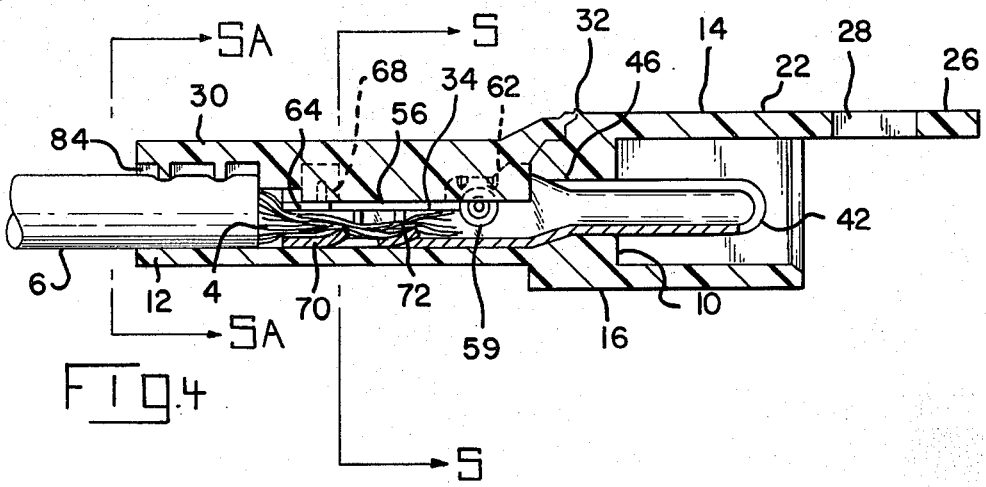
FIG. 4 is a view similar to FIG. 3 but showing the housing flap and the clamping flap in their closed positions.

The receptacle housing 8 has a housing flap 30 hinged as as shown at 32 to the upper sidewall 14. The hinge 32 is molded integrally with the housing and permits arcuate movement of the flap 30 from its open condition as shown in FIG. 3 to its closed position shown in FIG. 4.

When the housing flap is closed, a plurality of continuously enclosed cavities 34 extend through the housing from the wire entry face 12 to the mating face 10. These cavities are defined by barriers 38 which extend from the internal surface 39 of the flap 30 and fixed barriers 36 which extend from the internal surface of the lower sidewall 16.

The contact terminals 40 contained in the receptacle 2 are of stamped and formed sheet metal and each has a cylindrical contact portion 42 along which the seam 44 extends. The contact portion merges with a transition section 46 which, in turn, extends to a generally channel-shaped wire connecting portion 48 of the terminal. The wire connecting portion has a web 50 and sidewalls 54 which extend from the marginal side portions of the web. The sidewalls are of reduced height in their intermediate portions 49 and are relatively higher as shown at 51, adjacent to the transition section 46.

A flat sheet metal clamping flap 56 is hinged to the relatively higher portions 51 of the sidewalls, this clamping flap having ears 58 at one end thereof which are received in openings 59 in the sidewalls. It is desirable to emboss the sidewalls adjacent to the openings 59 as shown at 62 in order to stiffen these portions of the sidewalls so that they will withstand stresses developed when the clamping flap is moved to its closed position shown in FIG. 4. As shown in FIG. 3, the embossments extend inwardly and they serve to retain the clamping flap in its raised position. The flap is slightly flexed when it is moved to its closed position as it moves away from the embossments.

The intermediate portion of the clamping flap has a width which is substantially equal to the width of the channel-shaped connecting portion of the terminal and the flap is of reduced width, as shown at 64, at its free end. The clamping flap is latched in its closed position, shown in FIG. 4, by means of latching springs 68 which extend from ears 66 which extend from the upper edges of the sidewalls at the ends thereof. Latching springs 68 are formed inwardly so that their lower edges are located inwardly of the sidewalls 54. When the clamping flap is moved from the position of FIG. 3 to the position of FIG. 4, the latching springs 68 are flexed outwardly to permit passage of the reduced width section 64 of the flap. After the reduced width portion 64 moves below the springs 68, the springs return to their normal positions and hold the flap in its closed position.

A pair of wire engaging spring members or lances 70 are struck from the web 50 and formed upwardly as shown so that the upper edges of these lances bear against the strands of the wire when the wire is clamped in the terminal by the clamping flap 56. These lances 70 can be flexed downwardly by the wire and the terminal is thereby capable of use with wires of different diameters or gages. It is also desirable to form lances 72 in the intermediate portion of the clamping flap which bear against the strands of the wire to which the terminal is connected. The lances 72 are offset from the lances 70, as shown best in FIG. 4.

Figure 5A:
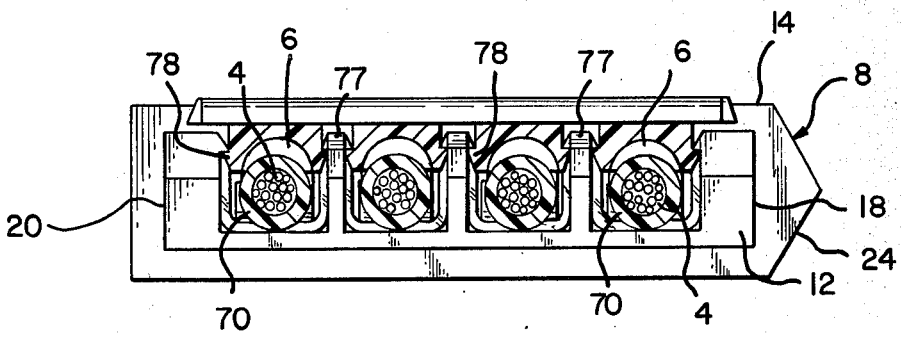
FIG. 5A is a view taken along the lines 5A—5A of FIG. 4.
Figure 5:
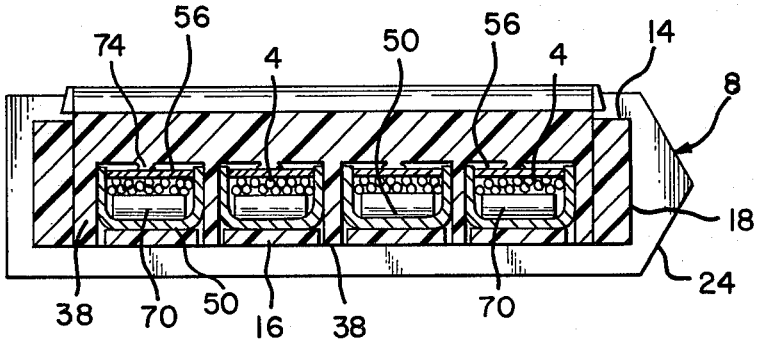
FIG. 5 is a cross-sectional view taken along the lines 5—5 of FIG. 4.

The internal surface 39 of the housing flap 30 has ribs 74 between the barriers 38 and these ribs are capable of being deformed, as illustrated in FIG. 5, when a relatively large diameter wire is connected to the terminal. The ribs bear against the upper surface of the flap and further assist in maintaining the flap against the strands of the wire. The ribs 74 thereby permit the use of the connector on a wide range of wire sizes. The terminals are retained in the cavities by means of outwardly projecting ears 55 which have an interference fit with fixed barriers 36.

The housing flap is latched in its closed condition by means of downwardly facing latching shoulders 76 on the barriers or cavity walls 36 which cooperate with upwardly facing shoulders 78 on the housing flap. The rearward portion 80 of the housing flap is provided with openings 82 that receive the upper edge portions 77 of the barriers 36 and the shoulders 78 are formed on each side of each of these openings. The flap is also provided with U-shaped recesses 84 which receive the portions of the insulation on the wires which are adjacent to the stripped ends of the wires. Transverse baffles 86 are formed in these recesses which engage the insulation of the wire and which are capable of deforming so that the wire insulation is clamped when the housing flap is in its closed position.

Figure 6:
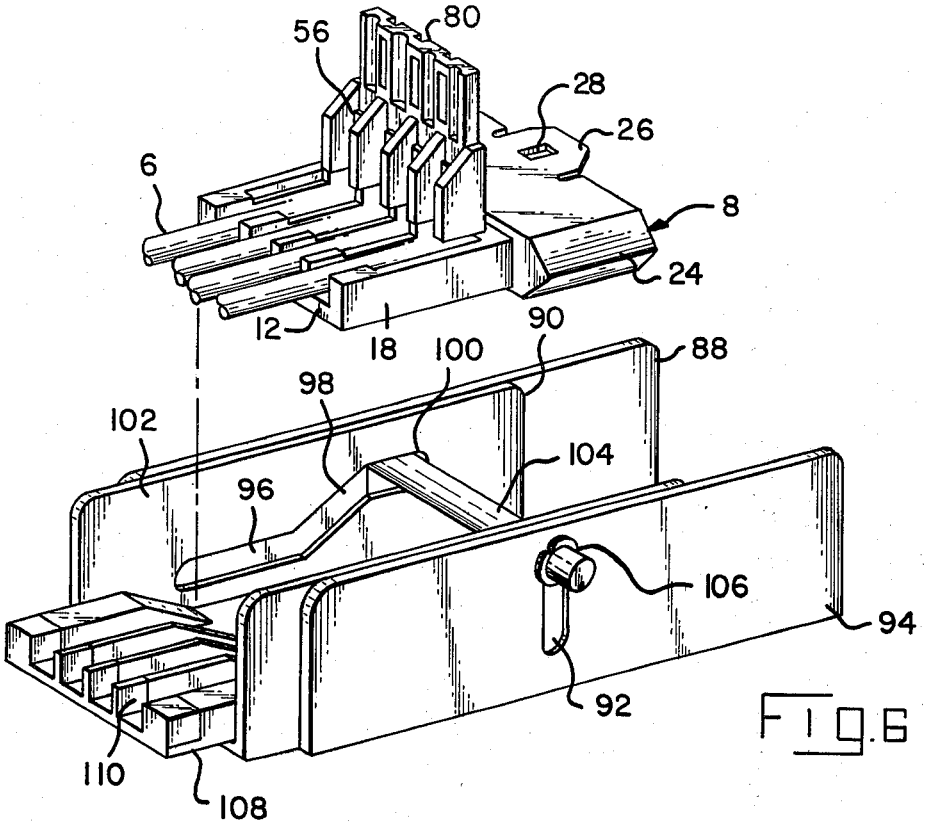
FIG. 6 is a perspective view of a tool for moving the housing flap of a connector from its open position to its closed position and showing a connector housing exploded from a connector receiving nest portion of the tooling device.
Figure 7:
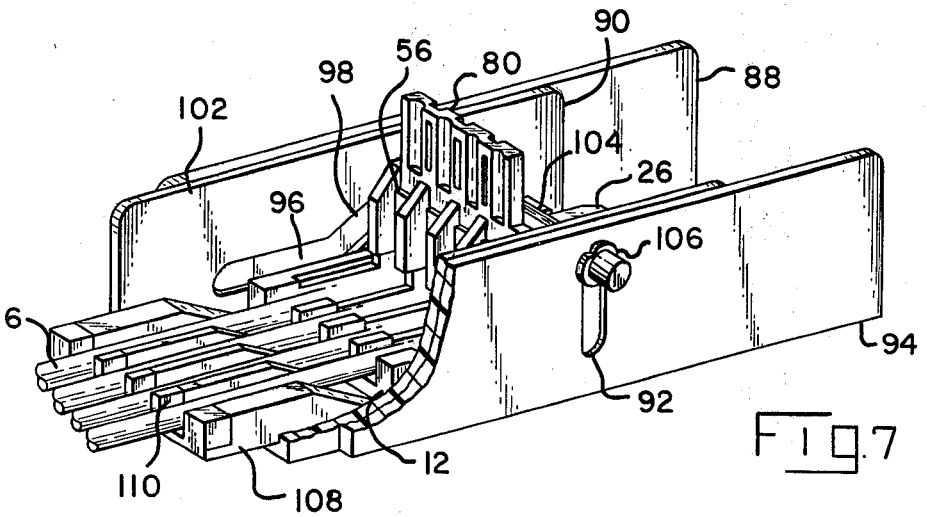
FIG. 7 is a view similar to FIG. 6 showing the connector positioned in the nest of the tool in preparation for closing of the housing flap.

The wires 4 are connected to the terminals in the housing by simply locating the wires with their stripped ends above the wire connecting portions of the terminals and thereafter closing the housing flap 30. A portion of the insulation of the wire will be located between adjacent cavity walls 36 and when the housing flap is closed, this portion of the insulation will be clamped between deformable baffles 84. Closing of the housing flap can be accomplished with a variety of types of tools and under some circumstances might be accomplished by hand. FIGS. 6 and 7 show one type of tooling arrangement which can be used in a simple hand tool or in an automatic machine.

The tooling shown in FIGS. 6 and 7 comprises an outer channel member 88 and an inner channel 90 which is slideable with respect to the outer channel. Vertical slots 92 are provided in the sidewalls 94 of the outer channel and contoured slots are provided in the sidewalls 102 of the inner channel 90. These contoured slots have an intermediate inclined portion 98 which extends from an end portion 96 which extends parallel to the web of the channel. A roller 104 extends between the sidewalls of the channels and through the slots, the ends of the roller having locking rings 106 thereon. The roller is normally disposed at the righthand end 100 of the slots in the inner channel 90. The housing is positioned on the web of the inner channel so that the roller is against the external surface of the housing flap. The wires are located with respect to the terminals by means of a locating fixture 108 mounted on the web of the inner channel 90 having spaced-apart wire locating slots 110 therein. After the wires have been so located, the outer channel is moved relatively leftwardly from the position shown in FIGS. 6 and 7 so that the roller moves relatively downwardly and swings the housing flap to its closed condition. The roller travels over the rearward end of the housing flap so that the latching shoulders 76, 78 will engage each other to lock the flap in its closed condition. The clamping flap is moved to its closed position and latched during movement of the housing flap.

Tooling of the type shown in FIGS. 6 and 7 can be mounted on a simple pair of plier type handles to produce a simple hand tool for installing connectors on wire ends. This type of tooling can also be used in automatic or semi-automatic harness making machines of the general type described in the above identified U.S. Pat. No. 4,043,017.

What is claimed is:

1. A preloaded electrical connector of the type comprising an insulating housing having a mating face and a wire entry face, oppositely facing sidewalls and oppositely facing endwalls extending between said faces, at least one terminal receiving cavity extending through said housing from said wire entry face to said mating face, a terminal in said cavity, said terminal having a wire connecting portion which is proximate to said wire entry face, one of said sidewalls having an integral housing flap which is hinged to said one sidewall at a location intermediate said faces, said housing flap being in an open position whereby a rearward portion of said cavity is exposed on one side thereof, said housing flap being movable to a closed position in which said cavity is closed on said one side, said connector being characterized in that:

said wire connecting portion of said terminal has a wire receiving portion and a wire clamping flap, said clamping flap being hinged to said terminal at an intermediate location thereon and being in an open position, said clamping flap extending beside said housing flap, said clamping flap being between said housing flap and the rearward end of said terminal, said clamping flap being movable to a closed position with said housing flap when said housing flap is moved to said closed position whereby, upon positioning the end portion of a wire adjacent to and in alignment with said wire receiving portion of said terminal and moving said housing flap to said closed position, said clamping flap is moved to its closed position and said wire is clamped to said wire receiving portion of said terminal, said wire receiving portion of said terminal and said clamping flap having first interengaging means to hold said terminal flap in said closed position, said housing and said housing flap having second interengaging means thereon to hold said housing flap in said closed position.

2. A preloaded electrical connector as set forth in claim 1, said housing having a plurality of cavities extending therethrough and having a terminal in each of said cavities.

3. A preloaded electrical connector as set forth in claim 2, said housing flap having an internal surface which is opposed to said clamping flap when said housing flap and said clamping flaps are in said closed positions, said internal surface having clamping flap engaging portions thereon which press said clamping flap against said wire.

4. A preloaded electrical connector as set forth in claim 3, said wire receiving portion of said terminal being channel-shaped and having a web and sidewalls extending from marginal side portions of said web.

5. A preloaded electrical connector as set forth in claim 4, said clamping flap being a separate part which is pivotally mounted on said terminal.

6. A preloaded electrical connector as set forth in claim 4, said clamping flap engaging portions on said internal surface of said housing flap comprising a rib which is deformable upon engagement with said clamping flap to compensate for variations in the diameter of said wire.

7. A preloaded electrical connector as set forth in claim 6, said internal surface of said housing flap having parallel spaced-apart cavity barrier walls extending therefrom, said barrier walls being between adjacent cavities when said housing flap is in said closed position.

8. A preloaded electrical connector as set forth in claim 4, said web having deformable wire supporting spring means extending therefrom, said spring means having wire engaging portions which are between said sidewalls, said spring means being deformable towards said web when said wire is clamped against said wire engaging portions by said wire flap.

9. A preloaded electrical conmector as set forth in claim 8, said spring means comprising cantilever springs, said wire engaging portion being the free ends of said cantilever springs.

10. An electrical connector, comprising:

dielectric housing means having terminal-receiving passageway means extending therethrough, said housing means being exposed in one side, housing-flap means hinged to said housing means for covering the exposed side;

electrical terminal means having contact means and conductor-securing means, said electrical terminal means disposed in said terminal-receiving passageway means with said conductor-securing means disposed in the exposed side of said housing means, securing means securing said electrical terminal means in said terminal-receiving passageway means, conductor-clamping means hingedly connected to said electrical terminal means as part of said conductor-securing means and extending along said housing-flap means when said housing-flap means and said conductor-clamping means are in an open position, said conductor-clamping means will clampingly connect conductive core means of insulated electrical conductor means in said conductor-securing means when ends of the insulated electrical conductor means are positioned into said conductor-securing means and said housing-flap means and said conductor-clamping means are moved to a closed position thereby electrically and mechanically connecting the electrical conductor means in the electrical terminal means and said housing means; and latching means on said housing means and said housing-flap means and on said conductor-securing means and said conductor-clamping means for latching said housing-flap means and said conductor-clamping means in the closed position.

11. An electrical connector as set forth in claim 10 wherein said housing-flap means includes clamping-flap sections for engaging said conductor-clamping means for pressing said conductor-clamping means against the conductive core means.

12. An electrical connector as set forth in claim 10 wherein said housing-flap means is integrally hinged to said housing means.

13. An electrical connector as set forth in claim 10 wherein said conductor-securing means is a channel-shaped member having a bottom member and side members, inwardly-directed lances located in said bottom member along which the conductive core means is to be disposed.

14. An electrical connector as set forth in claim 13 wherein inwardly-directed lance members are located in said conductor-clamping means which are offset with respect to said inwardly-directed lances of said bottom member.

15. An electrical connector as set forth in claim 10 wherein said housing-flap means has conductor-engaging means in the form of recess means having transverse baffle means for engaging the electrical conductor means when said housing-flap means is in the closed position.

* * * * *